United States Patent [19]

Martinetz

[11] 3,961,501

[45] June 8, 1976

[54] NEEDLE SELECTING ARRANGEMENT FOR A KNITTING MACHINE

[75] Inventor: Johann Martinetz, Hechingen, Germany

[73] Assignee: Mayer & Cie. Maschinenfabrik, Tailfingen, Wurttemberg, Germany

[22] Filed: Mar. 27, 1974

[21] Appl. No.: 455,205

[30] Foreign Application Priority Data

Apr. 4, 1973 Germany ..... 2316794

[52] U.S. Cl. ..... 66/154 A; 310/8.5

[51] Int. Cl.[2] ..... D04B 15/66

[58] Field of Search ..... 66/25, 50 R, 75, 154 A; 310/8.5, 8.6, 26

[56] References Cited

UNITED STATES PATENTS

| | | | |
|---|---|---|---|
| 2,067,877 | 1/1937 | Lawson et al. | 66/50 R |
| 3,229,482 | 1/1966 | Farmer | 66/50 R |
| 3,423,960 | 1/1969 | Weisinger et al. | 66/25 |
| 3,459,126 | 8/1969 | Nyman | 310/26 X |
| 3,815,383 | 6/1974 | Hamma | 66/50 R |
| 3,828,826 | 8/1974 | Hurzeler et al. | 66/50 R X |

FOREIGN PATENTS OR APPLICATIONS

| | | | |
|---|---|---|---|
| 1,563,200 | 3/1969 | France | 66/50 R |
| 483,511 | 2/1970 | Switzerland | 66/50 R |

*Primary Examiner*—Mervin Stein
*Assistant Examiner*—Andrew M. Falik
*Attorney, Agent, or Firm*—Michael J. Striker

[57] ABSTRACT

The knitting machine includes a carrier, and a plurality of knitting-needle units, each comprised of a needle portion and a motion-transmitting portion mounted on the carrier for longitudinal reciprocation and movable between an operative position and a non-operative position. A motion-imparting arrangement, for example comprised of lifting and lowering cams, impats longitudinal motion to those of the motion-transmitting portions which are in the operative position. A selecting arrangement selects the positions of the motion-transmitting portions. The selecting arrangement includes a selecting cam arrangement which is movable between a first position in which the selecting cam arrangement engages the motion-transmitting portions and moves the latter to one of the positions thereof and a second position in which the selecting cam arrangement is not operative for so moving the motion-transmitting portions. A cam-position control arrangement includes at least one cam position control member comprised of a material, for example piezoelectric material, which upon application of an energizing signal to the control member undergoes a dimensional change causing the control member to control the position of the selecting cam arrangement. As a further possibility, the selecting arrangement comprises a plurality of elongated force-transmitting members, one for each of the motion-transmitting portions, with each elongated force-transmitting member being mounted on the carrier. Control cams are mounted for movement relative to the carrier, or vice versa, and are operative for effecting longitudinal movement of the force-transmitting member to a position causing the respective motion-transmitting member to assume one of its respective positions. A biasing spring urges the force-transmitting member back in the opposite direction, and a detent of for example piezoelectric material is energizable or deenergizable to assume a position locking the force-transmitting member in the activated position thereof against the returning force of the biasing spring.

7 Claims, 23 Drawing Figures

NEEDLE SELECTING ARRANGEMENT FOR A KNITTING MACHINE

BACKGROUND OF THE INVENTION

The invention relates to a knitting machine flat or circular, with a patterning arrangement. The knitting machine itself is provided with a needle carrier, flat or circular, in which knitting needle units are longitudinally reciprocable to effect knitting. The knitting needle units comprised of needle portions and motion-imparting portions which are either integral with each other, or in the form of two distinct members. The patterning arrangement of the knitting machine causes the motion-imparting members to be selectively moved either to operative positions in which they are moved by lifting and lowering cams, or else to an inoperative position in which they are not so moved by the lifting and lowering cams.

More particularly, the invention relates to needle selecting arrangements for knitting machines, of the type wherein the needle selection is effected by energizing or deenergizing control members comprised of materials which undergo dimensional changes, for example piezoelectric, electrostrictive, magnetostrictive, or bimetallic control members, and the like, in contradistinction to the older and more familiar use of electromagnetic relays for this purpose.

It has already been proposed (in West German published Pat. applications Nos. 1,804,350 and 2,115,332) to replace the electromagnetic needle selector arrangements of known patterning arrangements, such as are almost universally employed in knitting machines now being manufactured, with piezoelectric members which bend and straighten in response to the application thereto of electrical energizing signals. This bending and straightening is to be understood to be comprehended within the meaning of the term "dimensional change", employed herein.

The piezoelectric or other control members can be so configurated and disposed as to effect a needle selecting operation. The great advantage of the use of piezoelectric control members, and the like, resides in that they can be alternately activated and deactivated with a very high frequency, and in that they undergo the dimensional changes with extreme quickness and little or no sluggishness or time lag. Also, in comparison to the electromagnets employed in conventional needle-selecting arrangements, they are of relatively small size. A disadvantage of the use of piezoelectric members and the like is that the actual force which they directly bring to bear is not great, compared for example to the force which can be exerted by an electromechanical relay. However, this limitation can be overcome by exploiting the combined action of a plurality of such piezoelectric control members, or the like, and/or by making use of such control members in needle-selecting arrangements where the control members are not called upon to create the actual force which moves the motion-imparting portions of the needle units into and out of engagement with the lifting and lowering cams.

SUMMARY OF THE INVENTION

It is a general object of the invention to provide a needle-selecting arrangement for a flat or circular knitting machine which makes use of control members of piezoelectric material, or of another material which, in dependence upon the application of an energizing electrical or magnetic signal, causes the control members to generate a force strong enough to control the needle-selection operation in a very efficient and reliable manner.

This object, and others which will become more understandable from the following description of specific embodiments, can be met, according to one advantageous concept of the invention, by providing a knitting machine which includes a carrier and a plurality of knitting-needle units, each comprised of a needle portion and a motion-transmitting portion mounted on the carrier for longitudinal reciprocation and movable between an operative position and a non-operative position. A motion-imparting arrangement, for example in the form of lifting and lowering cams, imparts longitudinal motion to those of the motion-transmitting portions which are in the operative position. A selecting arrangement selects the positions of the motion-transmitting portions. The selecting arrangement includes a selecting cam arrangement which is movable between a first position in which the selecting cam arrangement engages the motion-transmitting portions and moves the latter to one of the positions thereof and a second position in which the selecting cam arrangement is not operative for so moving the motion-transmitting portions. A cam-position control arrangement includes at least one cam position control member comprised of a material, for example piezoelectric material, which upon application of an energizing signal to the control member undergoes a dimensional change causing the control member to control the position of the selecting cam arrangement.

As a further possibility, the selecting arrangement may comprise a plurality of elongated force-transmitting members, one for each of the motion-transmitting portions, with each elongated force-transmitting member being mounted on the carrier. Control cams are mounted for movement relative to the carrier or vice versa, and are operative for effecting longitudinal movement of the force-transmitting member to a position causing the respective motion-transmitting member to assume one of its respective positions. A biasing spring urges the force-transmitting member back to the opposite direction, and a detent unit comprised for example of piezoelectric material is energizable and denergizable to assume a position locking the force-transmitting member in the activated position thereof against the returning force of the biasing spring.

If the selecting cam arrangement is employed, then it is advantageous that the arrangement be comprised of a selecting cam member having a cam surface the leading surface portion of which is inclined relative to the direction of relative movement between the carrier and the selecting cam.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

While the invention can be used both in circular and flat knitting machines, it will be explained with respect to circular knitting machines. Furthermore, whereas the inventive concept comprehends the use of control elements of a variety of materials, such as piezoelectric, electrostrictive, magnetostrictive, bimetallic, and the like, the invention is explained with respect to the use of piezoelectric control members.

Figure 1:
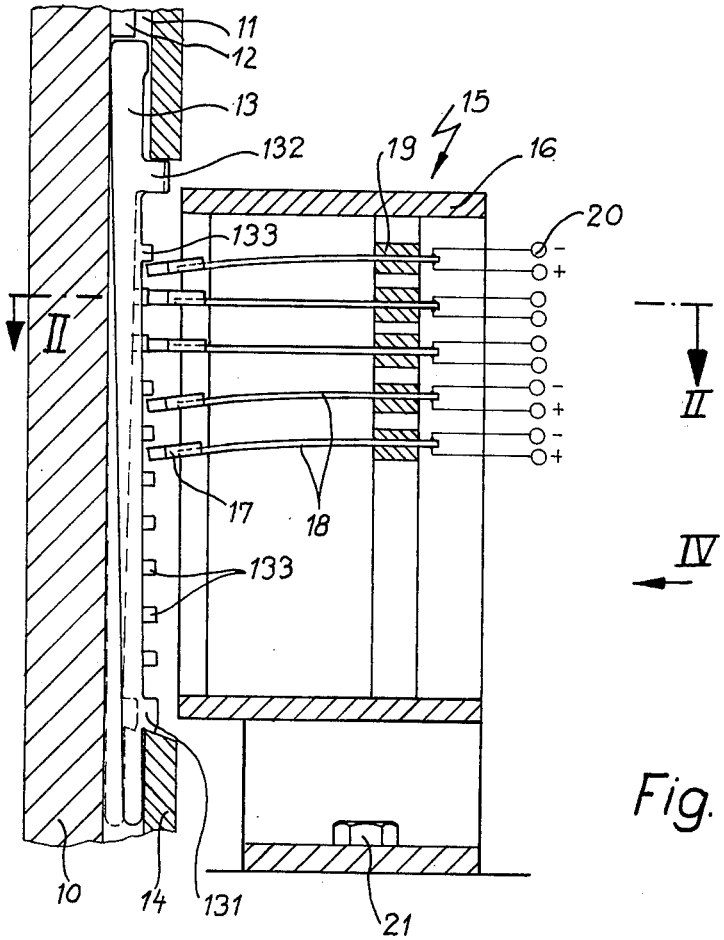
FIG. 1 is a section, taken on a radial plane, through a circular knitting machine, showing a portion of the rotating needle cylinder, and the stationary needle-selecting arrangement of the patterning arrangement of the knitting machine.
Figure 2:
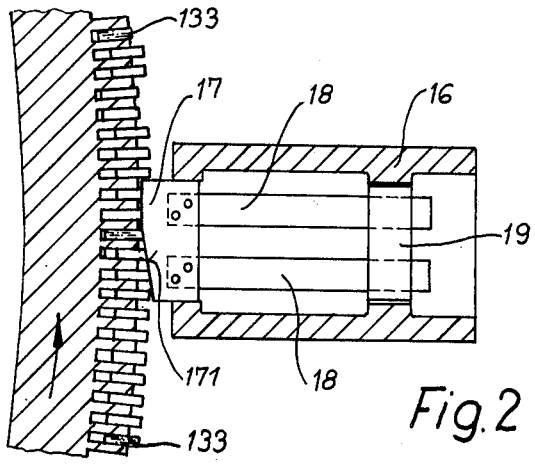
FIG. 2 is a section through the structure of FIG. 1, taken on line II—II.
Figure 3:
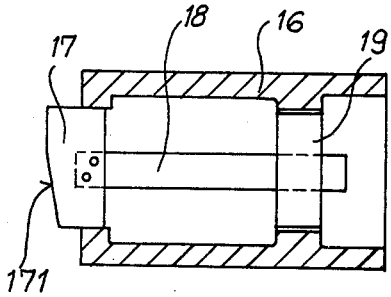
FIG. 3 is a section through the structure of FIG. 1, taken on line II—II, but showing an alternative construction.

In FIG. 1, numeral 10 designates the rotating needle cylinder of a circular knitting machine. This cylinder 10 constitutes a carrier provided with guide slots 11 in each of which is located a knitting-needle unit. Each knitting-needle unit is comprised of a needle portion 12 (only the lower end shown) and a motion-transmitting portion 13. In the illustrated embodiments, portions 12 and 13 are discrete, but they could of course be integral or rigidly connected with each other. The needle portion 12 and the motion-transmitting portion 13 are longitudinally reciprocable in the guide slot 11.

Figure 4:
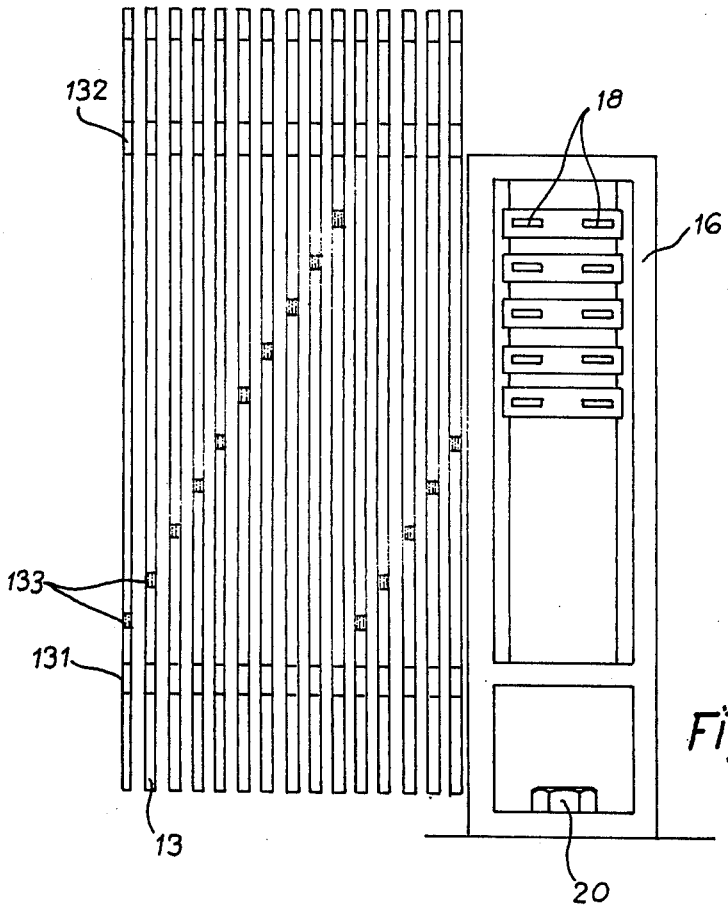
FIG. 4 is a view of the structure shown in FIG. 1, as seen in the direction of the arrow IV.

In per se known manner, the motion-transmitting portion 13 is pivotable or tiltable with respect to its upper portion, and is thereby capable of assuming either an operative or a non-operative position. The operative position is shown in FIG. 1 in solid lines, the non-operative position in broken lines. In the operative position, the cam-follower portion 131 of the motion-transmitting portion 13 is engaged and lifted by the stationary lifting cam 14, upon rotation of the needle cylinder. In the non-operative position, the cam-follower portion 131 is not engaged and lifted by the lifting cam 14. The motion-transmitting portion 13 furthermore includes an upper cam-follower portion 132 which is engaged by the illustrated lowering cam, which latter is operative for effecting lowering of the motion-transmitting portion 13, if and when the latter is raised by the lifting cam 14. The motion-transmitting portion 13 further includes a central cam-follower portion 133 which is engaged by cam means to be described below, for the purpose of selecting whether the motion-transmitting portion 13 is to occupy its operative or its non-operative position. The central cam-follower portions 133 of circumferentially successive motion-transmitting portions 13 are located at different levels, in accordance with the conventional practice of staggering these cam-follower portions; the staggered arrangement is shown in FIG. 4.

In FIG. 1, reference numeral 15 depicts generally the needle-selecting arrangement of the circular knitting machine. It will be understood by persons skilled in the art that any one such needle-selecting arrangement is associated with one of a plurality of yarn feeds and is operative for selecting whether the motion-transmitting portions 13 will occupy the operative or the non-operative positions thereof.

The needle-selecting unit is comprised of a plurality of selecting cams 17, one for each of the several planes of the staggered cam-follower portions 133, and each located in the respective plane. These selecting cams 17 each have a cam surface whose leading portion is inclined relative to the direction of relative movement between the rotating needle cylinder 10 and the stationary needle-selecting unit 15.

Each selecting cam member 17 is mounted on the free end of one or two lamella-like piezoelectric bending control members 18. Each such piezoelectric control member 18 is fixedly mounted at the other end thereof in the stationary housing 16, by means of a body of insulating material 19. Each piezoelectric control members 18 is provided on each of its two major surfaces with electrodes, which serve to apply to the piezoelectric portion of the control member 18 an electrical energizing signal, in this embodiment. The electrical energizing signals are applied to the piezoelectric control members 18 in the same way as energizing signals are applied to the electromagnetic relays of conventional needle-selecting arrangements. Usually, a more or less complex electronic patterning arrangement controls the application of such signals, in accordance with a preselected and often variable pattern; the electronic patterning arrangements are known per se and will not be described here, since they do not form part of the invention.

In any case, in accordance with the pattern to be knit, a D.C. voltage is or is not applied across the electrodes of the piezoelectric control member 18, to cause the same to bend or straighten. Alternatively, a D.C. voltage of one or the other polarity could be applied, to cause the piezoelectric control member 18 to bend in one or the other direction. Likewise, a D.C. voltage of either a first or a second magnitude could be applied, to cause the piezoelectric control member 18 to bend or straighten to a predetermined extent. The application of a D.C. energizing voltage to the piezoelectric control members 18 is depicted in FIG. 1 by means of pairs of terminals 20, those which have the D. C. voltage applied thereacross being designated with polarity markings.

In the embodiment of FIGS. 1–4, when no energizing voltage is applied across the electrodes 20 of the respective piezoelectric control member 18, the member 18 is straight, and the selecting cam 23 supported at the end thereof is in first position, in the path of movement of the cam-follower members 133, and accordingly operative for pushing the latter radially inwards upon engagement during needle cylinder rotation. Before each of the motion-transmitting portion 13 arrives at the needle-selecting arrangement 15, non-illustrated cam means push the member 13 outwards into its operative position, so that the cam member 27 can then push the member 13 back to non-operative position, if the respective piezoelectric control member 18 is in non-energized or straight condition.

The whole needle-selecting arrangement 15 is mounted by means of a screw 21 on a stationary part of the knitting machine.

A second embodiment is depicted in FIGS. 5–11. In this embodiment, the needle-selecting arrangement is designated by numeral 22 and is comprised of a plurality of selecting cams 23, arranged at different levels in correspondence to the different levels of the staggered cam-follower portions 343 of the motion-transmitting portions 34 of the knitting-needle units 31, 34.

Figure 6:
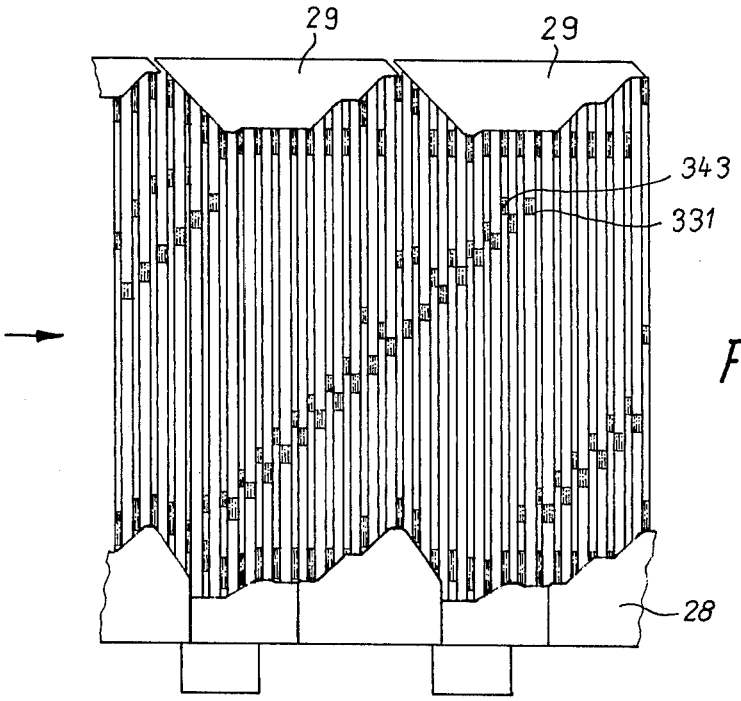
FIG. 6 is a section taken along line VI—VI of FIG. 7.
Figure 7:
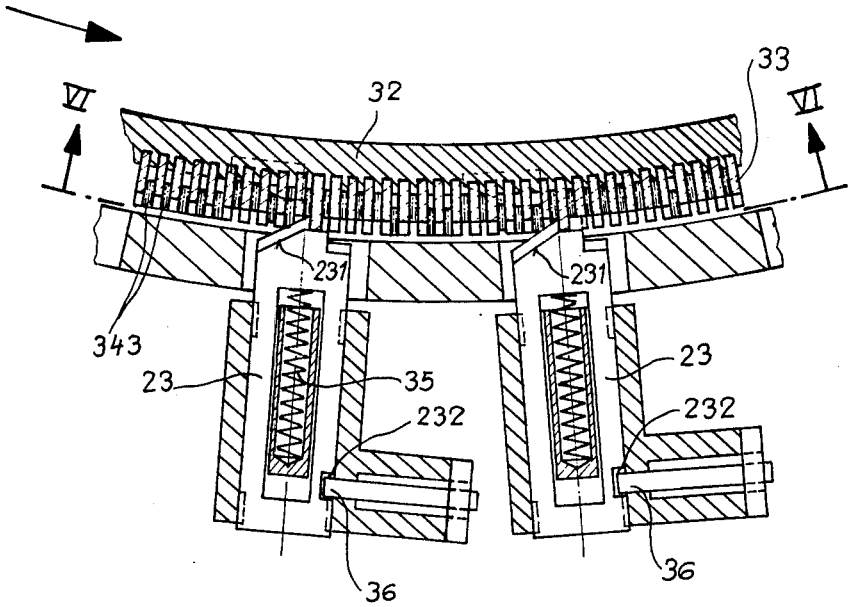
FIG. 7 is a section through the second embodiment, taken on line VII—VII in FIG. 5.
Figure 9:
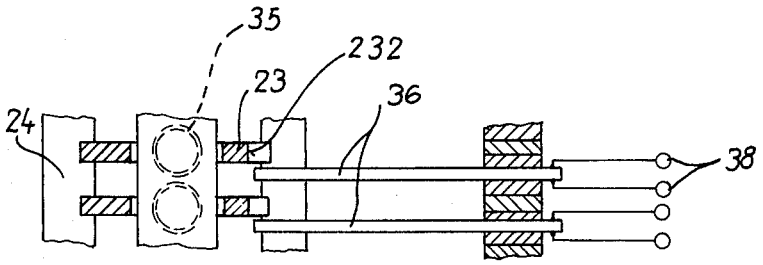
FIG. 9 is a section along line IX—IX of FIG. 8.
Figure 8:
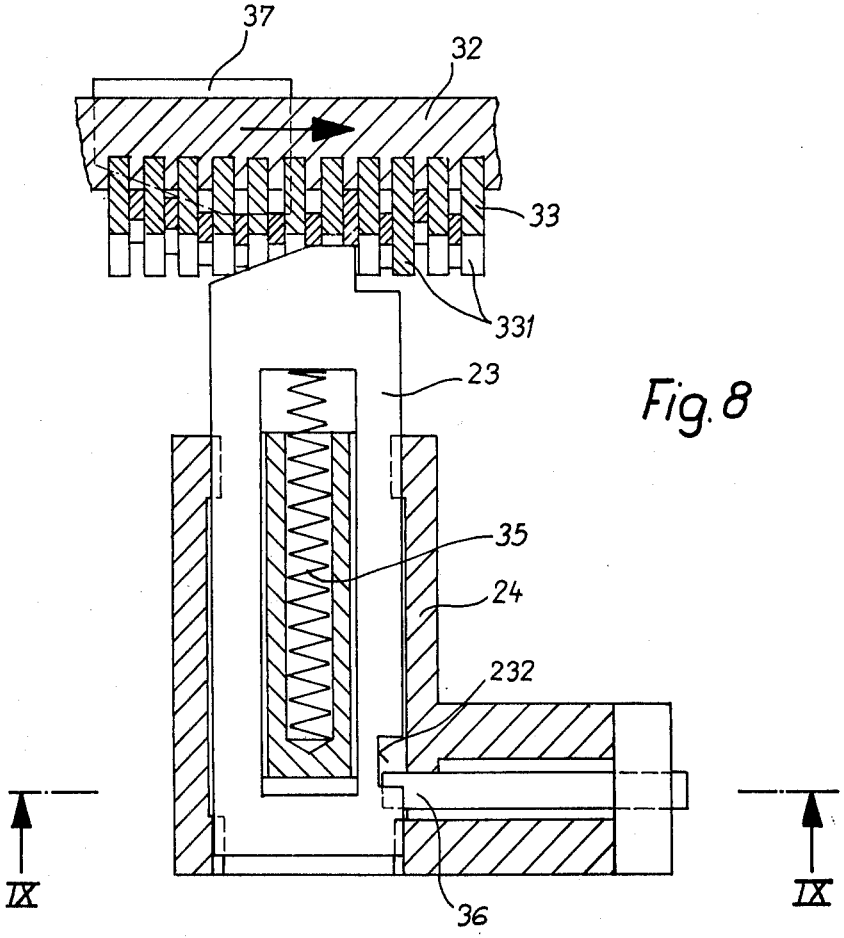
FIG. 8 is an enlarged view of a portion of FIG. 7.
Figure 11:
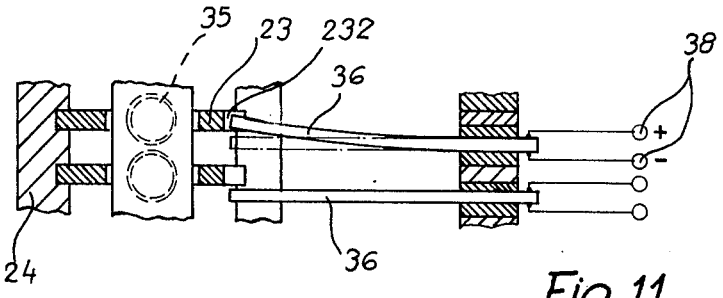
FIG. 11 is a section along line XI—XI of FIG. 10.

In the embodiment of FIGS. 1–4, the selecting cams 17 were movable in axial direction into and out of the path of movement of the respective cam-follower portions 133. In the embodiment of FIGS. 5–11, in contrast, the selecting cams 23 are movable radially inwardly and outwardly into and out of the path of movement of the respective cam-follower portions 343. FIG. 7 shows two selecting cams 23 in retracted or second position, whereas FIG. 8 shows one selecting cam 23 in non-retracted or first position. The selecting cams 23 are caused to remain in their retracted position, retracted into housing 24, or not, in dependence upon the condition of piezoelectric control means to be described.

Figure 5:
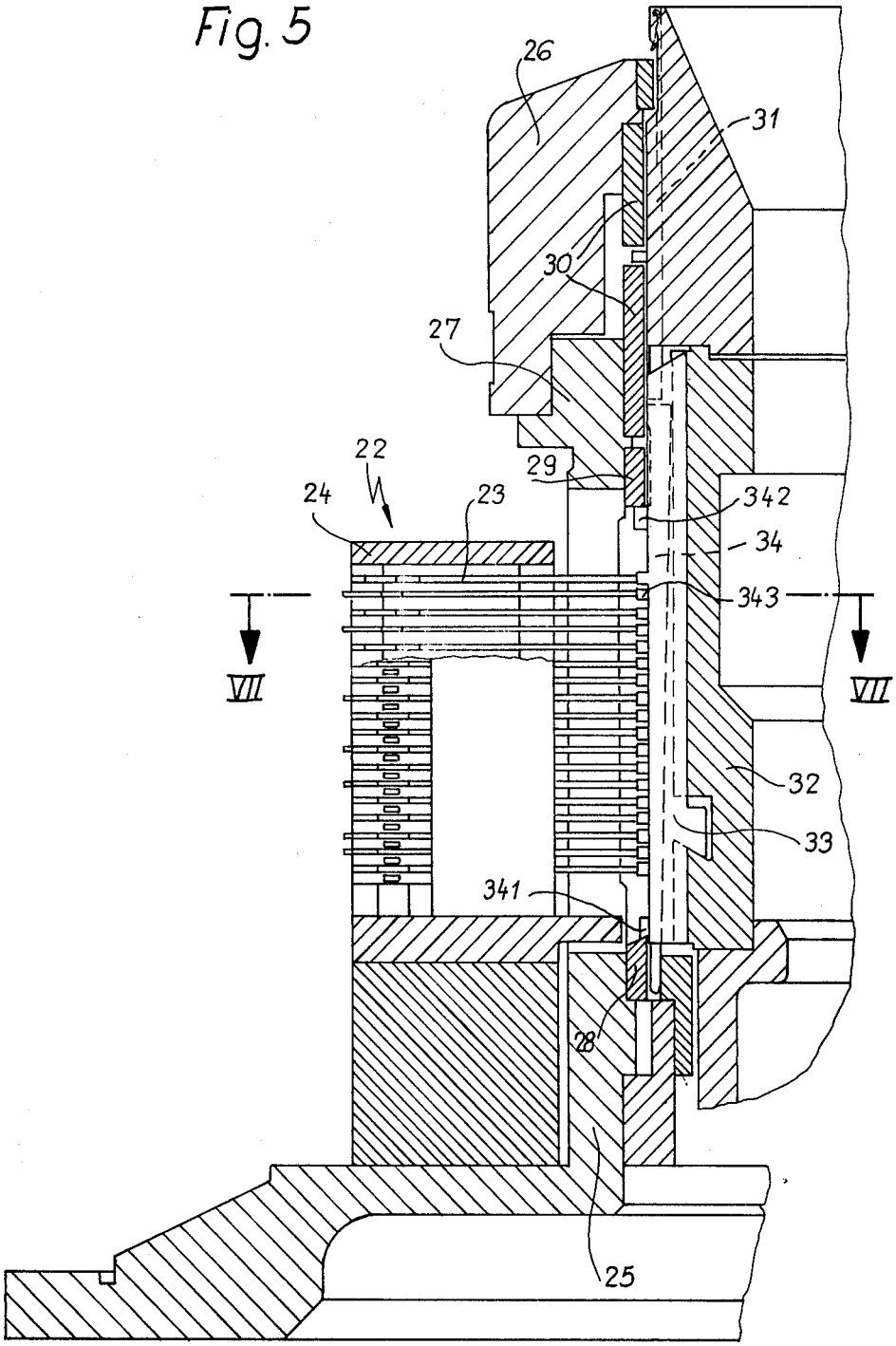
FIG. 5 is a section, taken on a radial plane, through a second embodiment.

FIG. 5 is a section, taken on a radial plane, through the knitting machine. The stationary part of the knitting machine is comprised of three mounting rings 25, 26, 27, for the lifting cams 28 and lowering cams 29 which act upon the motion-transmitting portions 34 if the latter are in operative position, and for the control cams 30 for the needles 31 of the circular knitting machine. Reference numeral 32 designates the needle cylinder, around the periphery of which are provided axially extending elongated members 33, adjoining pairs of which define between themselves the guide slots for the motion-transmitting portions 34 of the knitting-needle units 31, 34. As in the embodiment of FIGS. 1–4, the motion-transmitting portions 34 are each provided with a lower cam-follower portion 341 acted upon by the raising cams 28, an upper cam-follower portion 342 acted upon by the lowering cams 29, and a central cam-follower portion 343 acted upon by the needle-selecting cams 23. The central cam-follower portions 343 of circumferentially successive knitting-needle units 31, 34 are staggered in conventional manner.

Figure 10:
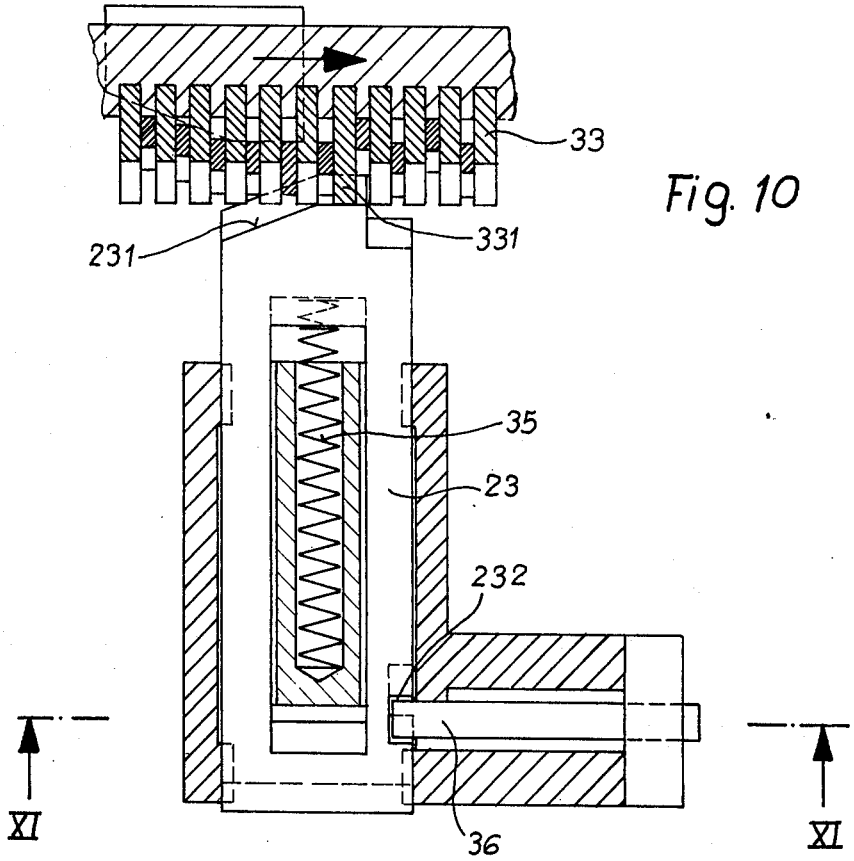
FIG. 10 is a view corresponding to FIG. 8 but depicting the selecting cam in non-retracted position.

As clearly depicted in FIGS. 7, 8 and 10, the radially inward portion of each selecting cam 23 is provided with a cam surface 231 the leading portion of which is inclined relative to the direction of needle cylinder rotation. As the motion-transmitting portions 34 associated with a particular selecting cam 23 are successively presented to the cam 23, an out-pushing cam (shown in dotted lines in FIGS. 7 and 8 and designated by numeral 37 in FIG. 8) pushes the motion-transmitting portions 34 radially outwards into operative position, so that the cam 23 can positively push cam-follower 343 of the portion 34 back radially inwards, if the cam 23 is in its first position (FIG. 8) as opposed to its second or radially outwardly retracted position (FIG. 7).

What determines whether the cam 23 assumes the first or non-retracted position (FIG. 8), or else the second or retracted position (FIG. 7), is the combined action of the pushing members 331, the piezoelectric control member 36 and the biasing spring 35.

As explained above, adjoining ones of the axially extending elongated members 33 define between themselves the axial guide slot for the motion-transmitting portion 34. Thus, the elongated members 33 alternate with the portions 34, in circumferential direction. Each of the elongated members 33 is provided with one pushing member 331. As can be seen in FIG. 6, the circumferentially successive pushing members 331 are staggered in the same way as the central cam-follower portions 343 of the motion-transmitting portions 34. Specifically, each pushing member 331 is associated with one respective cam-follower portion 343. As the needle cylinder 32 turns in the direction of the arrow in FIG. 7, and just before a cam-follower member 343 associated with a particular cam 23 reaches such cam, the associated pushing member 331 reaches the cam 23 and pushes the cam 23 radially outwards, against the force of compression spring 35. After being pushed radially outwards, into its second or retracted position, the cam 23 is then returned to its first or non-retracted position under the force of biasing spring 35, unless the piezoelectric control member 36 is energized.

Specifically, each selecting cam 23 is provided with a notch 232, and each piezoelectric control member 18 is configurated and arranged to act as an arresting member or detent. When the pushing member 331 pushes the cam 23 radially outwards into retracted position, the cam 23 will be arrested in such retracted position by reason of snapping of the piezoelectric latch 36 into the notch 232, if the piezoelectric latch 36 is energized (see upper latch 36 in FIG. 11). Accordingly, the cam-follower portion 343 associated with the pushing member 331, which latter has just pushed cam 23 into retracted position, will not be pushed radially inwards by such retracted cam 23.

In other words, each time a cam-follower portion 343 is about to be presented to the associated cam 23, the pushing member 331 associated with the particular portion 343 will first push the cam 23 into retracted position, and the cam 23 will either remain in retracted position, if the latch 36 is energized, and thereby not engage the follower portion 343, or else be immediately pushed out of retracted position by biasing spring 35 and accordingly engage the follower portion 343.

The control or latch member 36 itself is configurated in the form of a bar-shaped member and, as in the first embodiment of FIGS. 1–4, is fixedly mounted or embedded at one end and responds to the application of a D.C. voltage across its electrode terminals 38 (see FIG. 11) by bending out of its straight condition. When thus energized, the latch 36 at the free end thereof lies in the plane of the notch 232, and latching occurs and continues as long as the energizing signal is not removed.

A third embodiment is depicted in FIGS. 12–15. In this embodiment again, there are provided a plurality of axially extending guide slots on the needle cylinder 40, each slot accommodating a motion-transmitting portion 41 which is longitudinally reciprocated when engaged by working cams and which is tiltable back and forth between an operative position in which it becomes engaged by such working cams, and non-operative position in which it does not become engaged by such working cams.

In this third embodiment, of FIGS. 12–15, there is associated with each such motion-transmitting portion 41 a respective radially displaceable elongated force-transmitting member 42 received in a radially extending guide slot of a radially extending annular portion 43 which is rotatable with the needle cylinder 40. The radially displaceable force-transmitting member 42 is provided at its radially inward end with a projecting portion 421 which abuts against the motion-transmitting portion 41. A biasing spring 44 biases force-transmitting member 42 radially outwards, and a biasing spring 45 biases the lower portion of motion-transmitting portion 41 radially outwards. When the force-transmitting member 42 is slid radially inwards from its FIG. 12 position to its FIG. 13 position, the motion-transmitting portion 41 of the knitting-needle unit is thereby tilted from the operative to the non-operative position. As a result, the lower cam-follower portion 411 is moved out of engagement with the raising cam 411.

Figure 12:
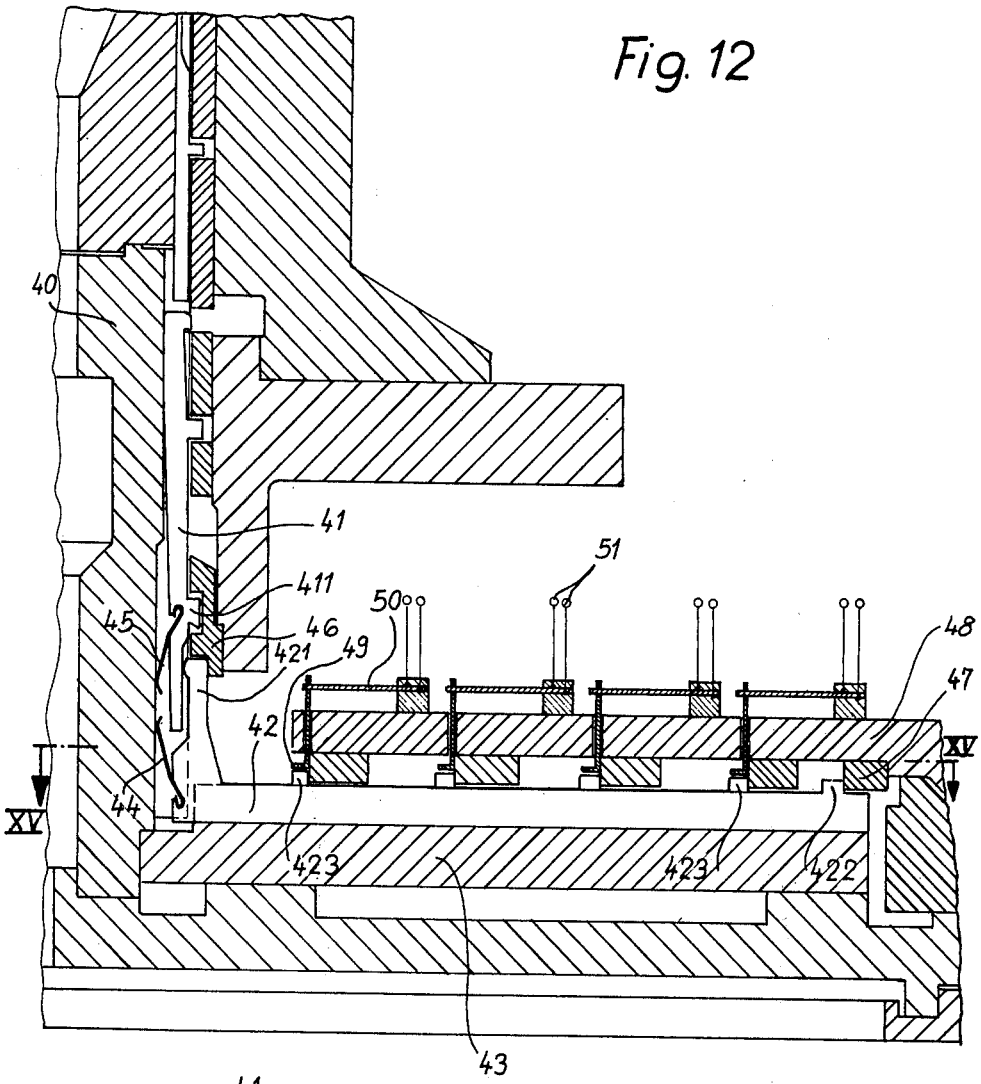
FIG. 12 is a section, taken on a radial plane, through a third circular knitting machine.
Figure 13:
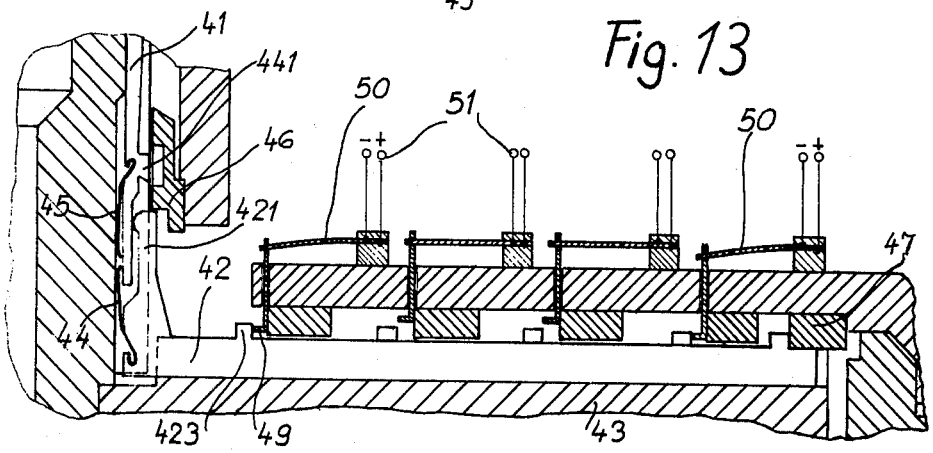
FIG. 13 depicts a portion of the structure shown in FIG. 12, but in a different stage of operation.
Figure 14:
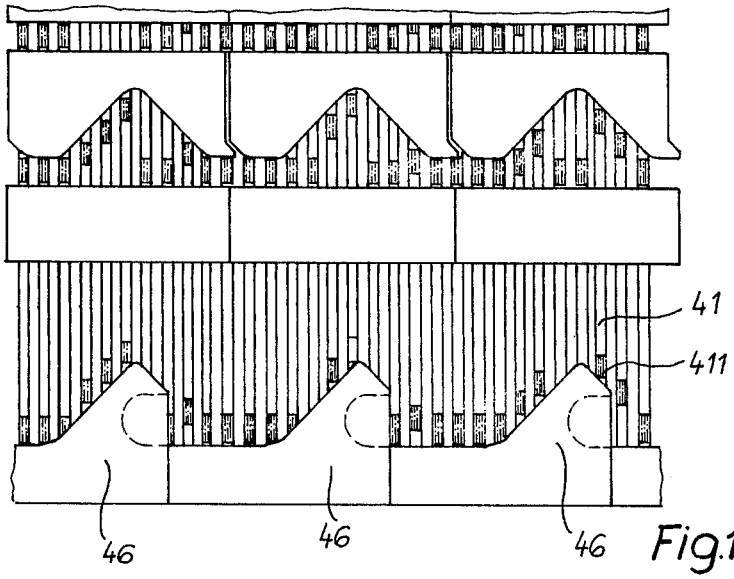
FIG. 14 depicts a portion of the needle cylinder of the third knitting machine, showing the lifting and lowering cams of the machine.
Figure 15:
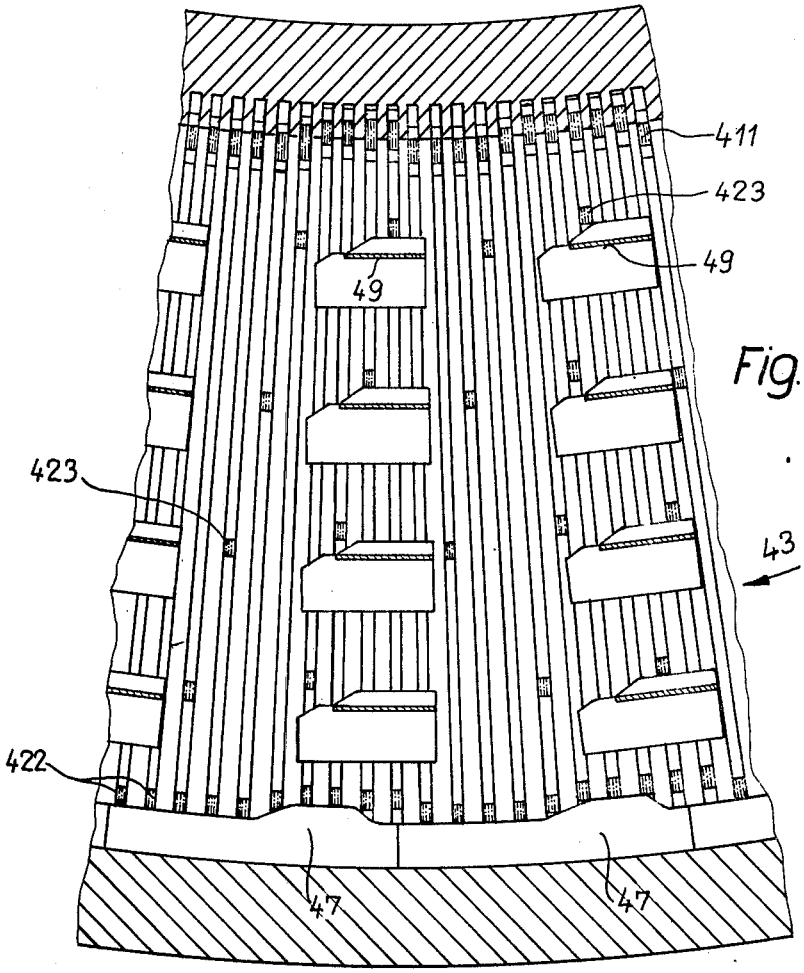
FIG. 15 is a section taken along line XV—XV in FIG. 12.
Figure 16:
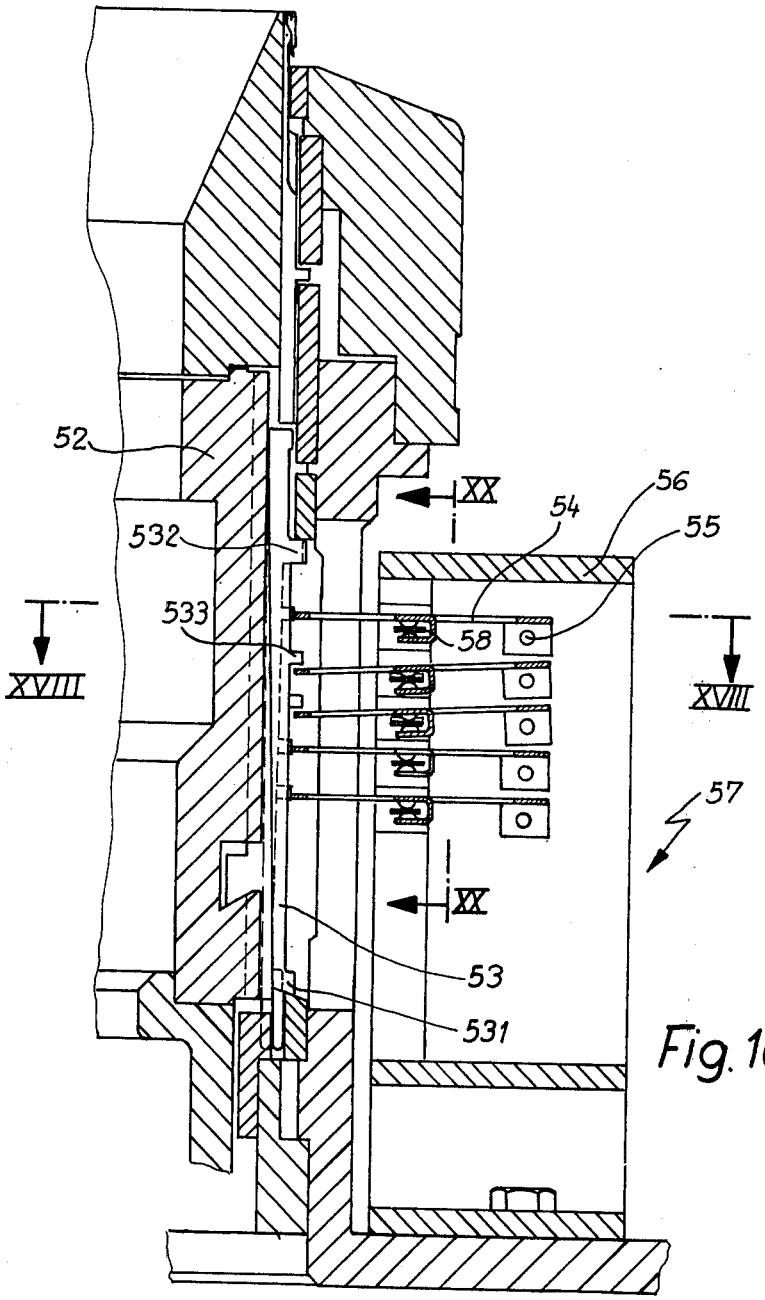
FIG. 16, is a section, taken on a radial plane, through a fourth circular knitting machine.
Figure 17:
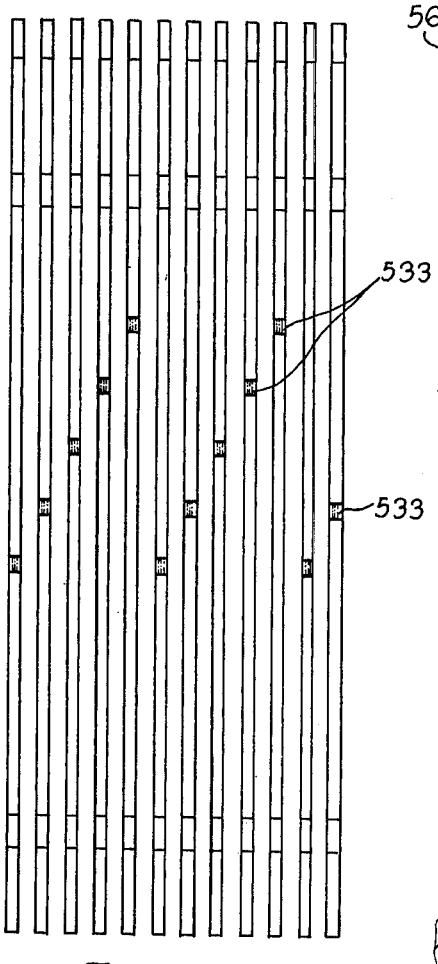
FIG. 17 shows a portion of the needle cylinder of the fourth knitting machine.

Longitudinal shifting of force-transmitting member 42 from its FIG. 12 to its FIG. 13 position is effected by means of cams 47, shown most clearly in FIG. 15. The cams 47 are supported on a stationary mounting ring 48 positioned above the rotating mounting ring 43 for the members 42. A stationary cam 47 is located circumferentially upstream of each needle-selecting arrangement the circular knitting machine. The stationary cams 47 act upon radially outwardly located cam-follower portions 422 of the force-transmitting members 42. Each member 42 is further provided with an upwardly projecting portion 423, the portions 423 of different members 42 being staggered in the manner depicted in FIG. 15, i.e., located in different orbits. The projecting portions 423 of each orbit cooperate with latch members 49, a latch unit being provided at each needle-selection location along each orbit. Each such latch unit is comprised of a piezoelectric bar 50, one end of which is fixedly mounted and on the other end of which there is supported the latch member 49. As shown in FIG. 12, ordinarily the latch member 49 is located above the level of the upwardly projecting portions 423 of the radially displaceable members 42. However, if the piezoelectric element 50, by means of its electrode terminals 51, has applied thereto a D.C. voltage, under the control of the conventional electronic patterning arrangement, then the element 50 bends downwards to the FIG. 13 position thereof, thereby pushing the latch member 49 downwards, and below the upper plane of the members 423 when latching action actually occurs.

The control cams 47 periodically cause the members 42 to move radially inwardly, to thereby move the respective motion-transmitting portion 41 to the non-operative position thereof. Thereafter, if latching action does not occur, the biasing spring 44 causes the member 42 to leave the FIG. 13 position thereof and reassume the FIG. 12 position. Energization of the piezoelectric element 50, if it occurs, occurs during the time that the member 42 has been temporarily pushed to its FIG. 13 position. Such energization will result in downwards bending of the element 50, and latching of the member 42 in its FIG. 13 position. Specifically, the latch element 49 will fall behind (radially outwards of) the respective upwardly projecting portion 423, thereby preventing return of member 42 to its FIG. 12 position. As a result, the motion-transmitting member 41 remains in its non-operative position and the cam-follower portion 411 thereof is not engaged by the lifting cam 46. As soon as the D.C. voltage across terminals 51 is removed, however, the piezoelectric element 50 straightens out, and the latch member 49 rises. This releases the member 42, which then returns to its FIG. 12 position, under the impelling force of biasing spring 44.

A fourth embodiment is depicted in FIGS. 16–20. In this embodiment, the selecting cam means, for selecting whether the motion-transmitting members 53 in the slots of the needle cylinder 52 are to be in the operative or non-operative position, is comprised of pivotally mounted members 54 (see FIG. 18) mounted by means of needle bearings 55, so as to be pivotable with the least possible friction. The motion-transmitting portions 53 of the knitting-needle units are again provided with lower cam-follower portions 531 which are engaged by the lifting cams, with upper cam-follower portions 532 which are engaged by the lowering cams, and with central cam-follower portions 533 which are engaged by the pivotable selecting cam members 54 at the cam surfaces 541 of the latter (see FIG. 18). Each needle-selecting arrangement 57 is comprised of a stack of such pivotable cam members 54, mounted in the housing 56 of the needle-selecting arrangement 57.

Figure 18:
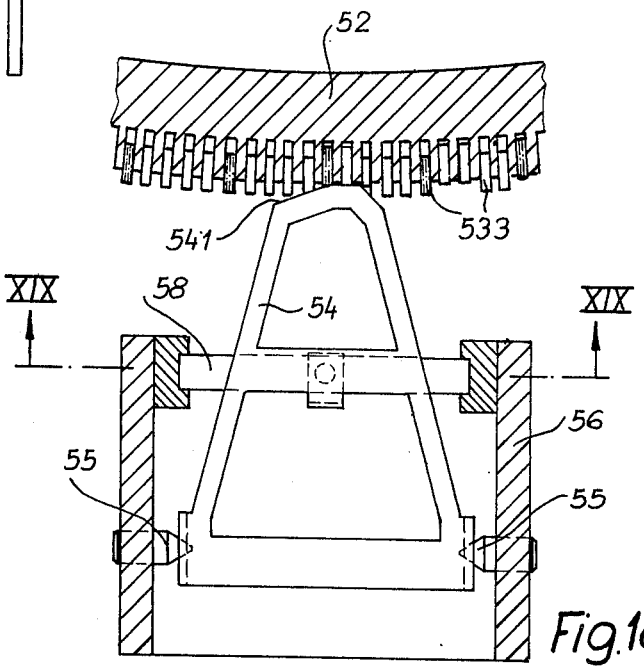
FIG. 18 is a section taken along line XVIII—XVIII of FIG. 16.

As shown in FIG. 18, the cam members 54 are pivoted at the radially outer ends thereof, and are each provided at the radially inner end thereof with a cam surface 541, the leading portion of which is inclined relative to the direction of movement of the needle cylinder 52. This cam surface 541 engages the central cam-follower portions 533 of the motion-transmitting members 53, for the purpose of needle selection. At its middle region, each pivotable cam member 54 is supported on an elongated piezoelectric member 58. Ordinarily, the inclined cam surface 541 of the pivotable cam member 54 is located in the path of travel of the cam-follower portions 533.

Figure 19:
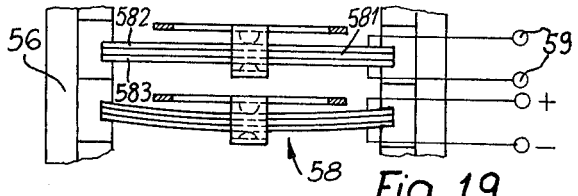
FIG. 19 is a section taken along line XIX—XIX of FIG. 18.
Figure 20:
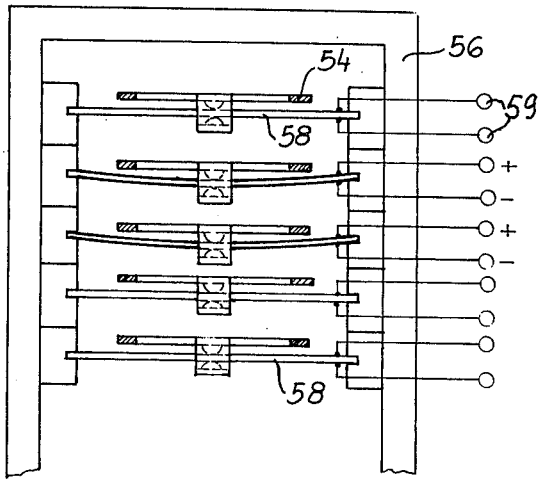
FIG. 20 is a section taken on line XX—XX of FIG. 16.

FIG. 19 depicts the construction of the piezoelectric control elements 58. Each control element 58 is comprised of a middle layer 581 of piezoelectric material sandwiched between two outer layers 582, 583 constituting electrodes for the element 58. Each of the two electrode layers 582, 583 is connected to a terminal 59. As soon as a D.C. voltage is applied across the two electrode layers 582, 583, the control member 58, fixedly clamped at both ends thereof, bends downwardly. As a result, the pivotable cam member 54 supported thereon lowers correspondingly, so that the cam surface 541 is no longer located in the path of travel of the cam-follower portions 533. FIG. 20 depicts a stack of such piezoelectric control members 58, some in energized and the others in unenergized condition. The energization of the piezoelectric control members 58 is performed by a conventional electronic patterning arrangement, of any of the known types conventionally employed to control the operation of conventional needle-selection arrangements of the type making use of electromagnetic relays.

Figure 21:
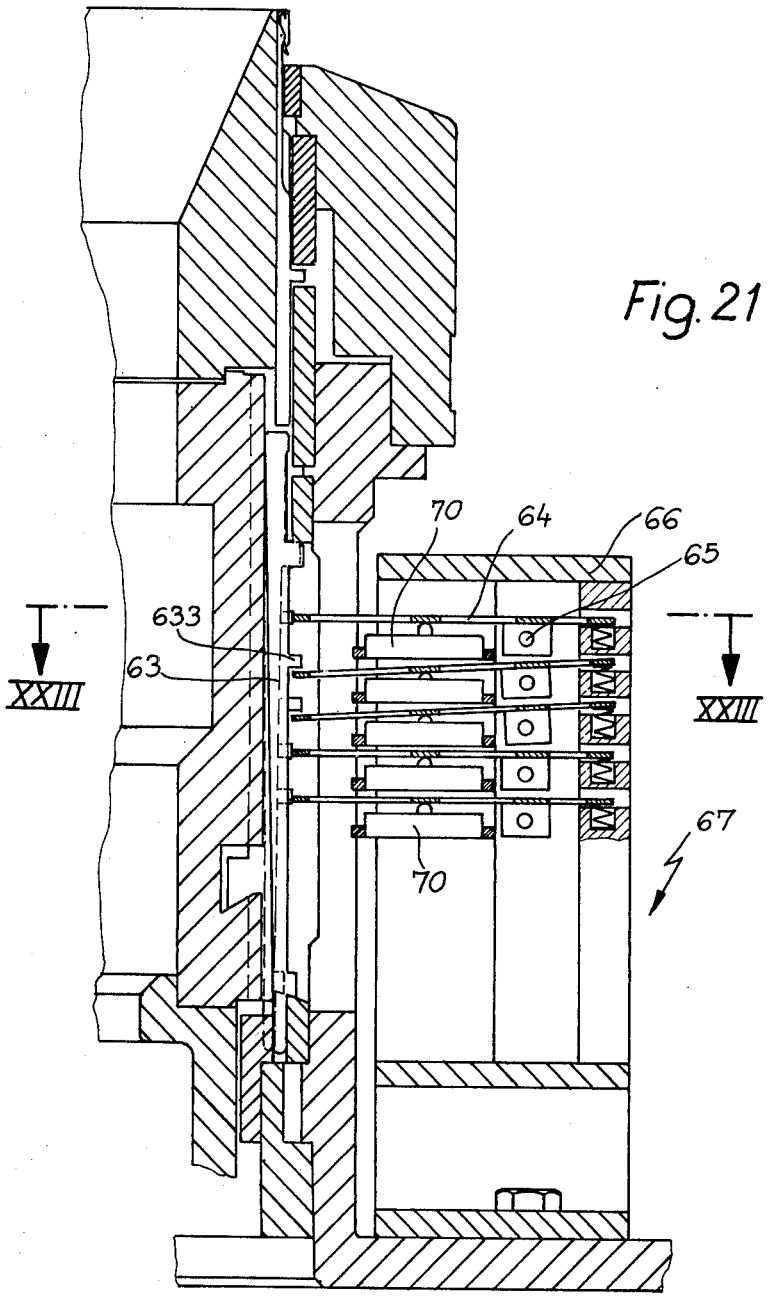
FIG. 21 is a section, taken on a radial plane, through a fifth circular knitting machine.
Figure 22:
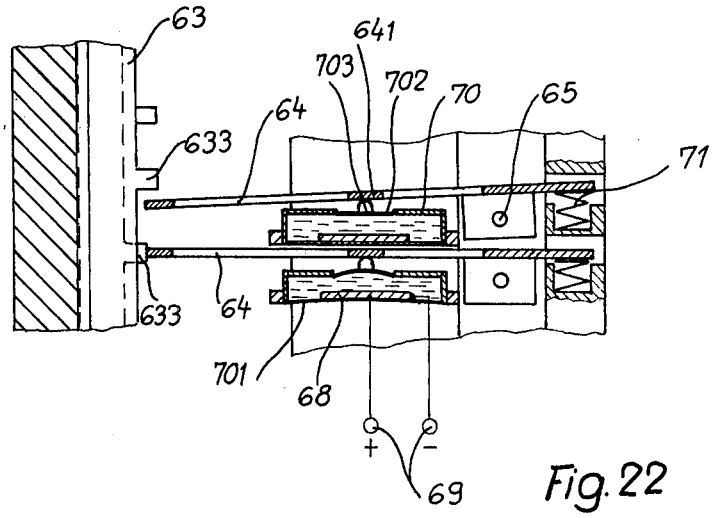
FIG. 22 depicts on a larger scale a portion of the structure shown in FIG. 21.
Figure 23:
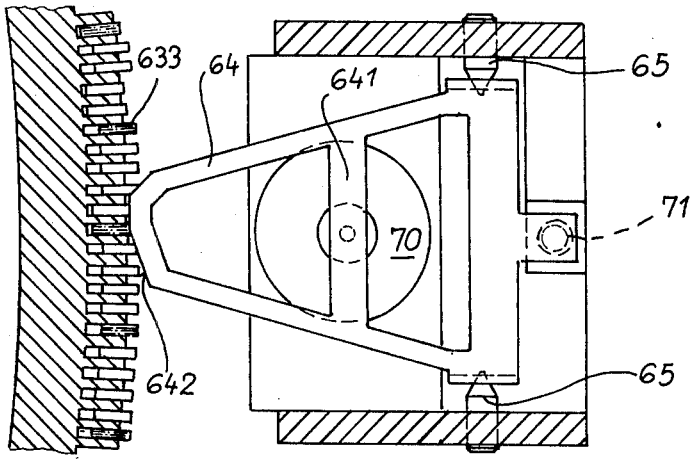
FIG. 23 is a section taken along line XXIII—XXIII of FIG. 22.

FIGS. 21–23 depict a fifth embodiment of the invention. The embodiment of FIGS. 21–23 differs from that of FIGS. 16–20 solely in the manner in which the pivotable cam members 64 are mounted and moved.

Again, the pivotable cam members 64 are mounted in the housing 66 of the needle-selection arrangement 65, and pivotably mounted by means of needle bearings 66. In this embodiment, the piezoelectric control members do not have the form of elongated piezoelectric members fixedly embedded at both ends thereof in a supporting structure. Instead, as seen clearly in FIG. 22, they each have the form of bending plates 68 mounted on the bottom 701 of a hydraulic capsule 70. The hydraulic capsule 70 at the upper portion thereof has an opening which is closed off in seal-tight manner by a flexible membrane 702. Mounted on the membrane 702 is a pressure pin 703, on which rests the central transverse portion 641 of the pivotably mounted cam member 64. The electrodes of the piezoelectric bending plate 68 are connected to terminals 69 which receive energizing or control signals in the form of D.C. voltages. When the piezoelectric plate 68 is energized, the whole bottom 701 of the hydraulic capsule caves in upwardly, and the membrane 702 with the pressure pin 703 mounted thereon bulges upwardly, thereby raising the pivotable cam member 64 from the position occupied by the lower cam member 64 in FIG. 22 to the position occupied by the upper cam member 64 in FIG. 22. This raising of the cam member 64 occurs against the opposition of a compression spring 71 which acts upon the radially outer part of the cam member 64. In contrast to the embodiment of FIGS. 16–20, the cam member 64 in the embodiment of FIGS. 21–23 is normally maintained by the biasing spring 71 in the second position thereof, i.e., in the position thereof wherein its cam surface 642 is not located in the path of travel of the cam-follower portions 633 of the motion-transmitting members 63. Only upon energization of the piezoelectric bending plate 64 of FIG. 22 does the cam surface 642 rise to the level of the associated cam-follower portions 633.

It will be understood that each of the elements described above, or two or more together, may also find a useful application in other types of constructions to be inserted differing from the types described above.

While the invention has been illustrated and described as embodied in an arrangement for selecting needles in a circular knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features which, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. In a knitting machine, in combination, a carrier; a plurality of knitting-needle units, each knitting-needle unit being comprised of a needle portion and a motion-transmitting portion mounted on said carrier for longitudinal reciprocation and movable between an operative position and a non-operative position; motion-transmitting means for imparting longitudinal motion to those of said motion-transmitting portions which are in said operative position; and selecting cam means including a selector cam movable in a predetermined direction between a first position in which said selector cam is operative for causing said motion-transmitting portions to be moved from one to the other of said positions thereof and a second position in which said selector cam is not operative for causing said motion-transmitting portions to be moved from one to said other of said positions, said selector cam having an engagement portion, means for moving said slector cam from one to the other of said positions thereof, and biasing means for normally urging said selector cam to said one of said positions; and cam position control means including at least one cam position control member in the form of a flexural detent member made of a material which upon alternate applications and removal of an energizing signal to said detent member undergoes alternate opposite dimensional changes causing said flexural detent member to bend about a predetermined bending axis oriented approximately parallel to said predetermined direction of movement of said selector cam to become engaged with and disengaged from said engagement portion, said flexural detent member being so disposed that when engaged with said engaging portion said detent member opposes the biasing force of said biasing means by exerting upon said selector cam a holding force in direction approximately parallel to said predetermined bending axis.

2. In a knitting machine as defined in claim 1, wherein said engagement portion is a portion having a notch alternately engaged and not engaged by said detent member.

3. In a knitting machine as defined in claim 1, wherein said control member is of piezoelectric material.

4. In a knitting machine as defined in claim 1, wherein said motion-transmitting portions and said selecting cam means are mounted for relative movement in direction transverse to the direction of longitudinal reciprocation of said knitting-needle units, and wherein said selector cam has a cam surface having an inclined leading portion which upon relative movement between said cam means and said motion-transmitting portions pushes motion-transmitting portions from one to the other of said positions of the latter.

5. In a knitting machine as defined in claim 1, wherein said selecting cam means has a cam surface with a leading portion inclined relative to the direction of said relative movement.

6. In a knitting machine as defined in claim 1, wherein said selecting cam means and said carrier are mounted for relative movement in direction transverse to the direction of longitudinal reciprocation of said knitting-needle units, and wherein said means for moving said selector cam from one to the other of said positions thereof comprises pushing portions on said carrier and operative upon relative movement between said carrier and said selecting cam means for pushing said selector to cause the latter to retract into one of said positions thereof.

7. In a knitting machine as defined in claim 6, wherein said detent member is comprised of piezoelectric material.

* * * * *